United States Patent [19]

Foster

[11] 4,341,932

[45] Jul. 27, 1982

[54] ELECTRIC SWITCHES

[75] Inventor: Terance J. C. Foster, Buxton, England

[73] Assignee: Otter Controls Limited, England

[21] Appl. No.: 193,447

[22] Filed: Oct. 3, 1980

[51] Int. Cl.[3] ..... H01H 21/40

[52] U.S. Cl. ..... 200/74; 200/325

[58] Field of Search ..... 200/325, 323, 321, 322, 200/318, 73, 74, 70

[56] References Cited

U.S. PATENT DOCUMENTS

| | | | |
|---|---|---|---|
| 304,557 | 9/1884 | Pirnie | 200/74 |
| 2,753,413 | 7/1956 | Anderson | 200/73 |
| 2,822,440 | 2/1958 | Karlsson | 200/74 |
| 3,213,244 | 10/1965 | McCarrick | 200/67 DA |

FOREIGN PATENT DOCUMENTS

| | | | |
|---|---|---|---|
| 184362 | 6/1963 | Sweden | 200/74 |

*Primary Examiner*—Willis Little

*Attorney, Agent, or Firm*—Fishman and Van Kirk

[57] ABSTRACT

An electrical switch comprising a snap-acting actuator (22) movable with a snap action between two configurations to control the making and breaking of electrical contacts (3, 6), a latching member which, when the actuator blade has snap-acted in one sense to break or make the contacts restrains return movement of a movable contact carrying member (22) (which may be the actuator) to prevent re-making of re-breaking of the contacts until the latching member is positively displaced, the latching member comprising a spring member (7) having an arm (10) defining a portion (18) for restraining return movement of the movable contact carrying member (22), the engaging portion (18) being arranged to move in a direction substantially parallel to the plane of the actuator blade between a latching position and a non-latching position and being biassed towards the latching position, the spring member (7) also having an operating portion (12) at an angle to the arm (10) and movable in a direction generally transverse to said plane to cause movement of said engaging portion (18) from the latching to the non-latching position, so as to permit return movement of the movable contact carrying member.

18 Claims, 4 Drawing Figures

ELECTRIC SWITCHES

Figure 1:
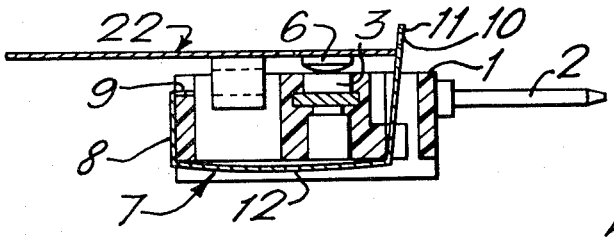

This invention relates to electric switches incorporating a snap-acting actuator comprising a stressed disc, sheet or strip of resilient sheet material (termed an actuator blade) movable with a snap-action between two configurations to control the making and breaking of the switch contacts, and a latching member which when the actuator blade has snap-acted in one sense to break or make the switch contacts restrains return movement of a movable contact carrying member to prevent re-making or re-breaking of the contacts i.e. the resetting of the switch until said latching member is positively displaced to permit return movement of the movable contact carrying member. Such switches will hereinafter be termed "switches of the kind described". The disc, sheet or strip of resilient material may be made of bimetallic material to provide a thermally-responsive switch or it may be made of suitable spring metal in which case the switch will be mechanically actuatable. The actuator blade itself may constitute the movable contact carrying member, or alternatively, the actuator blade may act upon a contact carrying or controlling strip of resilient sheet material to make or break the contacts.

Thermally-responsive switches of the kind described find widespread use in many areas of technology, particularly for protecting apparatus and appliances, such as electric motors or heaters, against over-heating. The latching member prevents the occurrence of a cycling behaviour in that the switch requires to be reset before any further operation of the apparatus or appliance can take place. Otherwise the actuator blade would simple snap back into its original configuration only to snap act yet again on further overheating and perform cycles indefinitely.

Switches of the kind described are disclosed in U.K. No. 1036127 wherein the latching member is in the form of a spring arm extending transversely with respect to the actuator blade and movable transversely to the plane of movement of the blade between its latching and unlatching positions. To displace the latching member and reset the switch requires a movement of the resetting member again transversely to the plane of movement of the actuator blade. If this resetting member were to be disposed close to the blade or contacts it would interfere with the operation of the actuator or the switch terminals, so it was disposed in a location spaced from the actuator. This however resulted in an undesirable increase in the overall size of the switch.

A further disadvantage of these known switches is that a substantial amount of movement of the actuator blade was required in order to release the latching member to spring into its latching position. This caused manufacturing difficulties since it needed to be ensured that actuator blades produced all possessed a sufficient amount of deflection to release the latching member.

It is an object of the invention to provide a switch of the kind described which does not have these disadvantages.

According to the invention there is provided a switch of the kind described wherein the latching member comprises a spring member having an arm extending generally transversely to the general plane of the actuator blade, said arm defining an engaging portion for restraining return movement of the movable contact carrying member, said spring member also having an operating portion connected with said arm at an angle thereto and extending generally parallel to said actuator blade, said operating portion being movable in a direction generally transverse to the general plane of the actuator blade to cause movement of said engaging portion of said arm in a direction generally parallel to the general plane of said actuator blade to permit return movement of said movable contact carrying member.

The engaging portion of the arm may engage the actuator blade or the contact carrying member where that member is separate from the actuator blade.

Thus the movement of the operating portion necessary for resetting the switch is in the direction of movement of the movable contact carrying member rather than transversely thereto and the difficulties mentioned earlier do not arise. Furthermore the operating portion and the engaging portion are integrally combined in a single spring member which is a substantial improvement in terms of manufacturing cost over previous switches where two or more components were provided to perform the same function.

Preferably the spring member is a spring strip and the operating portion is preferably bowed. Thus deflection of the central part of the operating portion causes the arm to pivot and the engaging portion to move in a direction substantially parallel to the general planes of the actuator blade and operating portion. The amount of bowing of the operating portion will preferably be such that a slight deflection of the operating portion causes a fairly substantial movement of the engaging portion.

A particularly convenient mounting of the spring member to the body of the switch is effected if the spring member is substantially U-shaped, i.e. the angled shape mentioned above with a further arm. In this way a wrap-around engagement of the spring member with the switch body may be obtained and the spring member can be mounted in position by means of its resilient engagement with the switch body.

In a preferred embodiment in which the engaging portion engages the actuator blade and in order to remove the point(s) of action of the engaging portion away from the main body of the blade, the latter is formed with an extension tab adapted to be engaged by the engaging portion.

In a preferred embodiment, the engaging portion of the arm of the spring member can comprise a bifurcated end of a spring strip which may bear against the actuator blade at two spaced locations in the latched position. This feature enables the tolerances in the pressed end part of the spring strip to be increased as the spaced abutments thereby formed accurately determine the latched position of the blade by preventing excessive travel of the engaging portion transversely to the plane of movement of the actuator blade.

The bifurcations may for example comprise two spaced ears formed at the end of the engaging portion of the spring strip. The ears may be bent out of the general plane of the arm towards the main body of the blade so as to prevent excessive movement of the blade thus decreasing fatigue of the blade and increasing the operating life of the blade.

As an alternative to the end of the spring strip being bifurcated, the arm of the spring may have a slot therein, an extension tab of the actuator blade entering the slot in the latched position. The tab then rests against one edge of the slot in the latched position, an opposite edge of the slot serving to prevent excessive movement of the blade.

Figure 2:
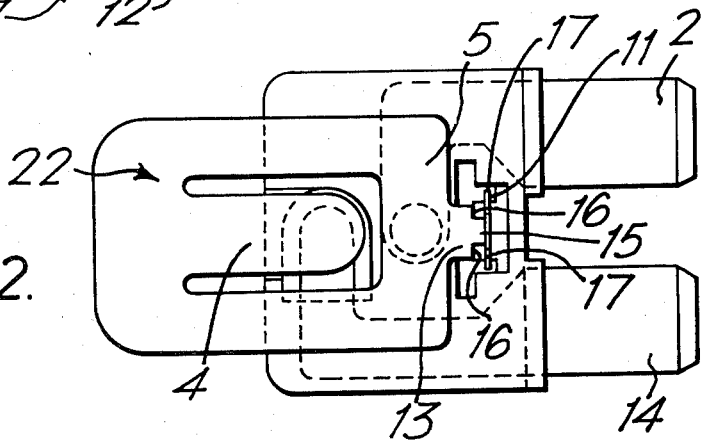
Figure 3:
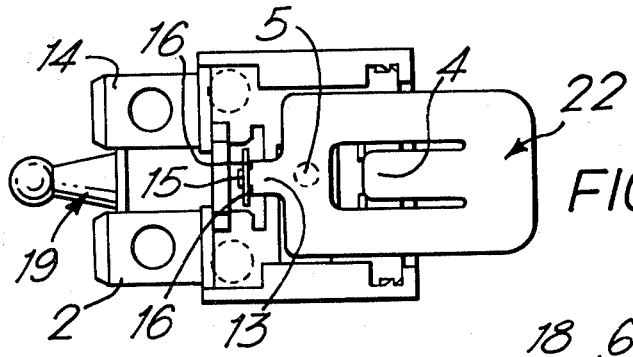
Figure 4:
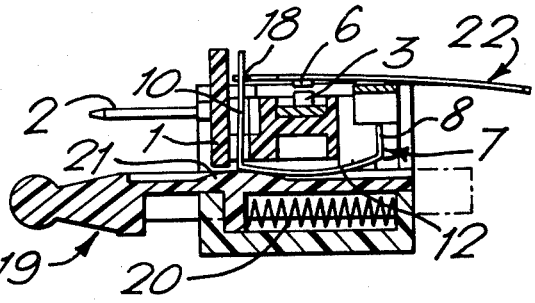

In order that the invention may be readily understood two embodiments thereof will now be described by way of example with reference to the accompanying drawings in which:

FIG. 1 shows a longitudinal section through a switch according to the invention, FIG. 2 is a plan view of the switch of FIG. 1, FIG. 3 is a plan view of a second embodiment of a switch according to the invention, and FIG. 4 is a section through the embodiment of FIG. 3.

In FIG. 1 there is shown a moulded plastics switch body 1 having terminals 2, 14 extending therefrom. One terminal 2 is connected to a switch contact 3 and the other terminal 14 is connected to the tongue 4 of a movable contact carrying member in the form of a known snap acting bimetallic actuator blade 22 which is mounted by means of the said tongue to the switch body 1. The bridge portion 5 of the actuator blade carries a movable contact 6.

A latching spring member in the form of a U-shaped copper alloy spring strip 7 is sprung around and then engaged to the switch body 1. The left hand arm 8 is formed with a flange 9 which engages about a shoulder on the switch body and serves to retain the spring strip on the body. The right hand arm or actuator blade engaging portion 10 is formed with a bifurcated actuator blade engaging end 11, and is resiliently biased in an anti clockwise direction to engage the actuator blade. The bridge or operating portion 12 of the U-shaped spring member is slightly bowed and it will be seen that upward pressure on this operating part will cause arm 10 to pivot clockwise (FIG. 1) and the end 11 will withdraw from the blade.

From FIG. 2 will be seen the extension tab 13 on the blade against which the end of the arm 10 engages, the arm 10 therefore being well spaced from contacts 3, 6. The tab 13 includes a narrow end portion 15 having a shoulder 16 on each side thereof. In the latched position of the switch, the portion 15 enters the gap between ears 17 of the bifurcated portion 11, and the shoulders 16 bear against the ears 17, thus preventing further anticlockwise movement of the arm 10.

On reaching a predetermined temperature the blade snaps through to open the contacts 3, 6 and this raising of the bridge portion 5 causes the arm 10 to deflect under its own resilience in an anticlockwise direction and the portion 15 to engage the gap between the ears 17 and restrain the blade from snapping through to its original configuration on a drop in temperature.

To reset the blade, upward pressure is applied to bowed portion 12, causing the end 11 of arm 10 to move substantially parallel to the general plane of the blade and allow the latter to remake the contacts 3, 6. This pressure can be applied by a simple button, by rotation of a coarsely threaded member, or lateral movement of a wedge or otherwise.

In a modified embodiment, the bifurcated end 11 of the arm 10 comprises two ears which are bent out of the plane of arm 10 towards the main body of the blade, i.e. to the left as seen in FIG. 1. When the blade snap acts to open the contacts, excessive travel of the actuator blade is prevented by engagement with the ears.

The embodiment of FIGS. 3 and 4 is similar to that of FIGS. 1 and 2 and identical parts have been given the same reference numerals. The features common to the two embodiments will not be further described.

In place of the bifurcated end 11 of the arm 10, the spring strip 7 has a rectangular slot 18 therethrough which the portion 15 of the tab 13 enters in the latched position of the switch. Thus, when the bimetallic actuator moves to break the contacts 3, 6, the portion 15 enters the slot 18 and further movement of the actuator is prevented by engagement of the portion 15 with the edge of the slot 18 which is shown as being uppermost in FIG. 4. Excessive actuator movement resulting in fatigue of the actuator is thus prevented. This feature can be enhanced by deformation of the portion of the arm 10 above the slot 18 towards the main body of the blade. When the blade attempts to remake the contacts 3, 6, for example upon cooling, this is prevented by engagement of the portion 15 with the edge of the slot which is shown as being lowermost in FIG. 4.

In addition, the embodiment of FIGS. 3 and 4 shows a reset slide member 19. The slide member 19 is biassed leftwardly as shown in the Figures by means of a coil spring 20. The member 19 includes a cam portion 21. When the slide member 19 is pushed rightwardly as shown in the Figures into the position indicated by broken lines in FIG. 4, against the force of the spring 20, the cam portion 21 exerts an upwardly directed force against the bowed portion 12 of the spring member 7, thus rotating the arm 10 of the spring member 7 in the anti-clockwise direction as shown in FIG. 4, thus allowing the actuator to make the contacts 3, 6. Once this has been done, and the member 19 is released, it returns to the illustrated position under the force of the spring 20.

I claim:

1. In an electric switch comprising a stationary contact and a movable contact, the movable contact being mounted on a carrying member for movement between a first and a second position, the switch further comprising actuator means including a stressed member of resilient sheet material movable with snap-action between two configurations to control the making and breaking of the contacts, the actuator means defining a plane, an improved latching means for restraining return movement of the contact carrying member after the actuator member has snap-acted in a first direction comprising:

a spring member having an arm extending generally transversely to the plane defined by the actuator means, said arm having a portion configured to engage the contact carrying member in the second position of the movable contact to prevent return of the movable contact to the first position, said spring member further comprising an operating portion integral with said arm and extending therefrom in a direction which is generally parallel to the plane defined by the actuator means, said spring member operating portion being at least partly movable in a direction generally transverse to the plane of the actuator means, movement of said spring member operating portion in said transverse direction imparting movement to said spring member arm in a direction generally parallel to the plane defined by said actuator means to cause disengagement of said engaging portion thereof from the contact carrying member whereby the movable switch contact may return to its first position.

2. The apparatus of claim 1 wherein the movable contact carrying member comprises the actuator means stressed member.

3. The apparatus of claim 1 wherein said spring member further comprises a second arm, said second arm being integral with and extending from an end of said operating portion disposed oppositely to the junction of said operating portion and first arm, said first and second arms and operating portion defining a generally U-shaped spring member.

4. The apparatus of claim 1 wherein said spring member comprises a spring strip.

5. The apparatus of claim 1 wherein said spring member first arm further includes means for preventing excessive travel of the movable contact carrying member.

6. The apparatus of claim 1 wherein said engaging portion of said spring member first arm comprises a bifurcated end of said arm, said bifurcated end including a of ears which form said engaging portion.

7. The apparatus of claim 1 wherein said engaging portion of said spring member first arm is defined by a slot.

8. The apparatus of claim 1 wherein the junction of said spring member first arm and operating portion defines substantially a right angle.

9. The apparatus of claim 1 wherein said engaging portion of said spring member first arm cooperates with a tab extending from the switch movable contact carrying member.

10. The apparatus of claim 1 wherein said engaging portion of said spring member first arm cooperates with a tab extending from the switch actuator means stressed member.

11. The apparatus of claim 9 wherein said tab is provided with shoulders on each side thereof, said shoulders bearing against the engaging portion of said spring member first arm.

12. The apparatus of claim 10 wherein said tab is provided with shoulders on each side thereof, said shoulders bearing against the engaging portion of said spring member first arm.

13. The apparatus of claim 1 further comprising:

means for causing resetting of said switch latching means, said resetting means comprising a reset member which engages the said operating portion of said spring member.

14. The apparatus of claim 13 wherein said reset member is slidable in a direction generally parallel to the plane defined by the actuator means and comprises a cam which engages said spring member operating portion.

15. The apparatus of claim 13 wherein said reset member is movable generally transversely with respect to the plane defined by the actuator means.

16. The apparatus of claim 15 wherein said reset member is rotatable about and may in part be moved along an axis which is generally transverse to the surface of said spring member operating portion.

17. In an electric switch comprising a stationary contact and a movable contact, the movable contact being mounted on a carrying member for movement between a first and a second position, the switch further comprising actuator means comprised of a stressed resilient sheet material and having a member movable with snap-action between two configurations to control the making and breaking of the contacts, the actuator means member defining a plane, an improved latching means for restraining return movement of the contact carrying member after the actuator member has snap-acted in a first direction comprising:

a spring member having an arm extending generally transversely to the plane defined by the actuator means snap-action member, said arm having a portion configured to engage the contact carrying member in the second position of the movable contact to prevent return of the movable contact to the first position, said spring member further comprising a curved operating portion integral with said arm and extending therefrom in a direction which is generally parallel to the plane of the actuator means snap-action member, said spring member operating portion being at least partly movable in a direction generally transverse to the plane defined by the actuator means snap-action member, movement of said spring member operating portion in said transverse direction imparting movement to said spring member arm in a direction generally parallel to the plane defined by said actuator means snap-action member to cause disengagement of said engaging portion thereof from the contact carrying member whereby the movable switch contact may return to its first position.

18. In an electric switch comprising a stationary contact and a movable contact, the movable contact being mounted on an actuator comprised of a stressed resilient sheet material, the actuator including a member movable with snap-action between two configurations to control the making and breaking of the contacts, said actuator member defining a plane, an improved latching means for restraining return movement of the actuator member after the actuator member has snap-acted in a first direction comprising:

an arm extending generally transversely to the plane defined by the actuator member, said arm having a portion configured to engage the actuator member in a second configuration thereof to restrain return of the actuator member to its first configurations, and an operating member integral with said arm and extending therefrom in a direction which is generally parallel to the plane defined by the actuator member, said operating member being at least partly movable in a direction generally transverse to the plane defined by the actuator member, movement of said operating member in said transverse direction imparting movement to said arm in a direction generally parallel to the plane defined by said actuator member to cause disengagement of said engaging portion thereof from the actuator member.

* * * * *